US009054411B2

(12) United States Patent
Zhang et al.

(10) Patent No.: US 9,054,411 B2
(45) Date of Patent: Jun. 9, 2015

(54) ANTENNA COMPONENT AND ELECTRONIC COMMUNICATION DEVICE

(71) Applicant: Huawei Device Co., Ltd., Shenzhen (CN)

(72) Inventors: Bin Zhang, Shenzhen (CN); Yaming Jiang, Wuhan (CN); Pengsheng Chen, Wuhan (CN)

(73) Assignee: HUAWEI DEVICE CO., LTD., Shenzhen (CN)

( * ) Notice: Subject to any disclaimer, the term of this patent is extended or adjusted under 35 U.S.C. 154(b) by 242 days.

(21) Appl. No.: 13/729,740

(22) Filed: Dec. 28, 2012

(65) Prior Publication Data

US 2013/0113663 A1 May 9, 2013

Related U.S. Application Data

(63) Continuation of application No. PCT/CN2011/077048, filed on Jul. 12, 2011.

(30) Foreign Application Priority Data

Jul. 12, 2010 (CN) ..... 2010 1 0227602
Aug. 13, 2010 (CN) ..... 2010 2 0291352 U

(51) Int. Cl.
*H01Q 1/24* (2006.01)
*H01Q 1/22* (2006.01)
(Continued)

(52) U.S. Cl.
CPC ..... *H01Q 1/241* (2013.01); *H01Q 1/2275* (2013.01); *H01R 13/44* (2013.01); *H01R 35/04* (2013.01); *H01R 2107/00* (2013.01)

(58) Field of Classification Search
CPC ..... H01Q 1/2275; H01Q 1/241; H01R 35/04; H01R 13/44; H01R 2107/00
USPC ..... 343/700 MS, 702, 872, 873
See application file for complete search history.

(56) References Cited

U.S. PATENT DOCUMENTS 7,066,753 B1 6/2006 Tseng
7,443,343 B2 * 10/2008 Schlegel et al. ..... 343/700 MS
(Continued)

FOREIGN PATENT DOCUMENTS

CN 1491156 A 4/2004
CN 201156604 Y 11/2008
(Continued)

OTHER PUBLICATIONS

International Search Report issued in corresponding PCT Patent Application No. PCT/CN2011/077048, mailed Oct. 20, 2011.
(Continued)

*Primary Examiner* — Hoanganh Le
(74) *Attorney, Agent, or Firm* — Brinks Gilson & Lione

(57) ABSTRACT

The embodiments of the invention discloses an antenna component and an electronic communication device. The antenna component comprises a plate-shaped front cover made of a transparent plastic material and at least one antenna made of a conductor material. The front cover comprises an antenna accommodation part and a circuit accommodation part. One end of the antenna is embedded in the antenna accommodation part via an injection molding process, and the other end of the antenna extends to the circuit accommodation part and is exposed out of the circuit accommodation part. The electronic communication device comprises a housing, a circuit board, and an antenna component disclosed in the present invention. The present invention is applied to reduce the volume of the antenna component.

10 Claims, 7 Drawing Sheets

(51) Int. Cl.

| | |
|---|---|
| ***H01R 35/04*** | (2006.01) |
| *H01R 13/44* | (2006.01) |
| *H01R 107/00* | (2006.01) |

(56) References Cited

U.S. PATENT DOCUMENTS

| | | | | |
|---|---|---|---|---|
| 2004/0082370 | A1* | 4/2004 | Gahl et al. | 455/575.5 |
| 2007/0270022 | A1 | 11/2007 | Lin | |
| 2009/0215284 | A1 | 8/2009 | Zhao et al. | |
| 2010/0029330 | A1 | 2/2010 | Hertlein et al. | |
| 2010/0039347 | A1* | 2/2010 | Chen et al. | 343/873 |
| 2012/0008268 | A1 | 1/2012 | Jiang et al. | |
| 2012/0194393 | A1* | 8/2012 | Uttermann et al. | 343/702 |

FOREIGN PATENT DOCUMENTS

| | | | |
|---|---|---|---|
| CN | 201242759 | Y | 5/2009 |
| CN | 201298604 | Y | 8/2009 |
| CN | 101652040 | A | 2/2010 |
| CN | 201417877 | Y | 3/2010 |
| CN | 101931133 | A | 12/2010 |
| CN | 201682164 | U | 12/2010 |
| CN | 201758176 | U | 3/2011 |
| JP | 2000269662 | A | 9/2000 |
| JP | 2001256461 | | 9/2001 |
| JP | 2002094324 | A | 3/2002 |
| JP | 2003085523 | A | 3/2003 |
| JP | 2003234668 | A | 8/2003 |
| JP | 2005258974 | A | 9/2005 |
| JP | 2006121149 | A | 5/2006 |
| JP | 2006270448 | A | 10/2006 |
| JP | 3130455 | | 3/2007 |
| JP | 2008022250 | A | 1/2008 |
| JP | 2008287628 | A | 11/2008 |
| JP | 2010121742 | A | 6/2010 |
| WO | WO 2009105953 | A1 | 9/2009 |

OTHER PUBLICATIONS

Written Opinion of the International Searching Authority issued in corresponding PCT Patent Application No. PCT/CN2011/077048, mailed Oct. 20, 2011.

Written Opinion of the International Searching Authority issued in corresponding PCT Patent Application No. PCT/CN2011/077046, mailed Sep. 22, 2011.

International Search Report issued in corresponding PCT Patent Application No. PCT/CN2011/077046, mailed Sep. 22, 2011.

Office Action issued in corresponding Japanese Patent Application No. 2011-153706, mailed Nov. 20, 2012.

Extended European Search Report issued in corresponding European Patent Application No. 11173445.5, mailed Sep. 30, 2011.

Office Action issued in corresponding Chinese Patent Application No. 201010257477.X, mailed Feb. 22, 2011.

* cited by examiner

ANTENNA COMPONENT AND ELECTRONIC COMMUNICATION DEVICE

CROSS-REFERENCE TO RELATED APPLICATION

This application is a continuation of International Application No. PCT/CN2011/077048, filed on Jul. 12, 2011, which claims priority to Chinese Patent Application No. 201010227602.2 filed on Jul. 12, 2010, titled "USB CONNECTOR, USB HOUSING AND WIRELESS MODEM", and CN Application No. 201020291352.4 filed on Aug. 13, 2010, titled "ANTENNA COMPONENT AND ELECTRONIC COMMUNICATION DEVICE", which are incorporated herein by reference in its entirety.

FIELD OF THE INVENTION

The present invention relates to the field of mechanical technologies, and in particular, to an antenna component and an electronic communication device equipped with the antenna component.

BACKGROUND OF THE INVENTION

With the ceaseless development of electronic technologies and communication technologies, electronic devices such as data card have become one of the tools frequently used by a user who often surfs on the Internet using a notebook computer, and antenna component is an important integral component on the existing electronic communication devices such as data card.

As shown in FIG. 1, it illustrates an electronic device equipped with a plug 5. The electronic device includes: a housing 3, a circuit board 4 arranged inside the housing 3, a plug 5 electrically connected with (via a USB plug in the figure exemplarily) one end of the circuit board 4, an antenna 2 electrically connected with the other end of the circuit board 4 and a protective cap 50 for covering the plug 5. The existing antenna component includes a support 1 and an antenna 2, wherein the antenna 2 is made of a metal material, the support 1 is a plastic piece, one end of the antenna 2 is equipped with a via hole and fixed on the support 1 by a screw or bolt passing through the via hole, and the other end of the antenna 2 is pressed against and thus electrically connected with an antenna contact on the circuit board 4 in the electronic device.

The antenna 2 may input a data signal in a wireless signal format that the antenna receives to the circuit board 4 via the antenna contact. The circuit board 4 may also send a data signal to the antenna 2 via the antenna contact, and then the antenna 2 emits the data signal in a wireless signal mode.

It is inadvisable to change the position of the antenna 2 after being adjusted, otherwise, the receiving effect of the data signal in a wireless signal format will be influenced. Therefore, in order to protect the devices such as the antenna component and the circuit board 4, etc., the housing 3 of the existing electronic devices will completely cover the circuit board 4 and the antenna component, and a protective cap 50 is inserted on the plug 5 of the electronic device, wherein the protective cap 50 and the housing 3 together function to protect the plug 5 of the electronic device and various devices inside the housing 3.

The inventors find, during the implementation of the invention, that there at least exist the following problems in the prior art:

In the existing antenna component as shown in FIG. 1, the antenna 2 is fixed on the support 1 via a screw or bolt, and the structure of the screw or bolt makes the volume of the antenna component large, thereby making the volume of the housing 3 for covering the antenna component and the volume of an electronic device equipped with the antenna component very large.

SUMMARY OF THE INVENTION

The embodiments of the invention provide an antenna component and an electronic communication device equipped with the antenna component, thereby solving the technical problem that the volume of existing antenna components is large.

To attain the above object, the following technical solutions are employed in the embodiments of the invention:

An antenna component, including a plate-shaped front cover made of a transparent plastic material and at least one antenna made of a conductor material; wherein The front cover includes an antenna accommodation part and a circuit accommodation part, wherein one end of the antenna is embedded in the antenna accommodation part via an injection molding process, and the other end of the antenna extends to the circuit accommodation part and is exposed out of the circuit accommodation part.

An electronic communication device, including: a housing, a circuit board and an antenna component; the antenna component includes a plate-shaped front cover made of a transparent plastic material and at least one antenna made of a conductor material, wherein The front cover includes an antenna accommodation part and a circuit accommodation part, wherein one end of the antenna is embedded in the antenna accommodation part via an injection molding process, and the other end of the antenna extends to the circuit accommodation part and is exposed out of the circuit accommodation part, and the other end of the antenna is pressed against and thus electrically connected with an antenna contact on the circuit board; the housing covers the circuit board and the circuit accommodation part.

In comparison with the prior art, any one of the above technical solutions provided in the invention has the following advantages:

In the antenna component according to the embodiments of the invention, the front cover includes an antenna accommodation part and a circuit accommodation part, one end of the antenna is embedded in the antenna accommodation part via an injection molding process, and the other end of the antenna extends to the circuit accommodation part and is exposed out of the circuit accommodation part. The antenna is embedded in the antenna accommodation part via an injection molding process, and no screw or bolt, or a connection structure like screw or bolt, is arranged between the antenna and the front cover. In comparison with the existing antenna component, the overall volume of the front cover and the antenna can be made smaller due to the omit of the space occupied by the screw or bolt or a connection mechanism like screw or bolt. At the same time, because the front cover is plate-shaped and no screw or bolt or a connection mechanism like screw or bolt is arranged, the antenna component can be made more thinner and lighter, thereby solving the technical problem that the volume of existing antenna components is large.

When an antenna component according to the embodiments of the invention is arranged on an electronic communication device, the volume of the electronic communication device can also be made smaller and thinner, and the electronic communication device will be easier for a user to carry and use.

In addition, because in the embodiments of the invention, the front cover is made of a transparent plastic material, when an indicator lamp or other light-emitting device in the housing of the electronic communication device emits light, the light may penetrate through the front cover, so that a flare effect will be generated on the whole front cover, and a greater aesthetic sense will be made on its appearance.

BRIEF DESCRIPTION OF THE DRAWINGS

The drawings illustrated here are used to provide a further understanding of the invention and form a part of the application, rather than limiting the scope of the invention. In the drawings.

In order to more clearly illustrate the technical solutions of the embodiments of the invention or of the prior art, the drawings needed in the description of the embodiments or the prior art will be briefly introduced below. Apparently, the drawings in the description below are only some embodiments of the invention, and other drawings may also be obtained by one of ordinary skills in the art according to these drawings without creative labors.

DETAILED DESCRIPTION OF THE EMBODIMENTS

The technical solutions in the embodiments of the invention will be described clearly and fully below in conjunction with the drawings in the embodiments of the invention. Apparently, the embodiments described are only a part of the embodiments of the invention, rather than being the whole embodiments. All the other embodiments obtained by one of ordinary skills in the art based on the embodiments of the invention without creative labors pertain to the protection scope of the invention.

One embodiment of the invention provides an antenna component with a smaller volume, a lower cost and a much elegant appearance, and an electronic communication device equipped with the antenna component.

Figure 1:
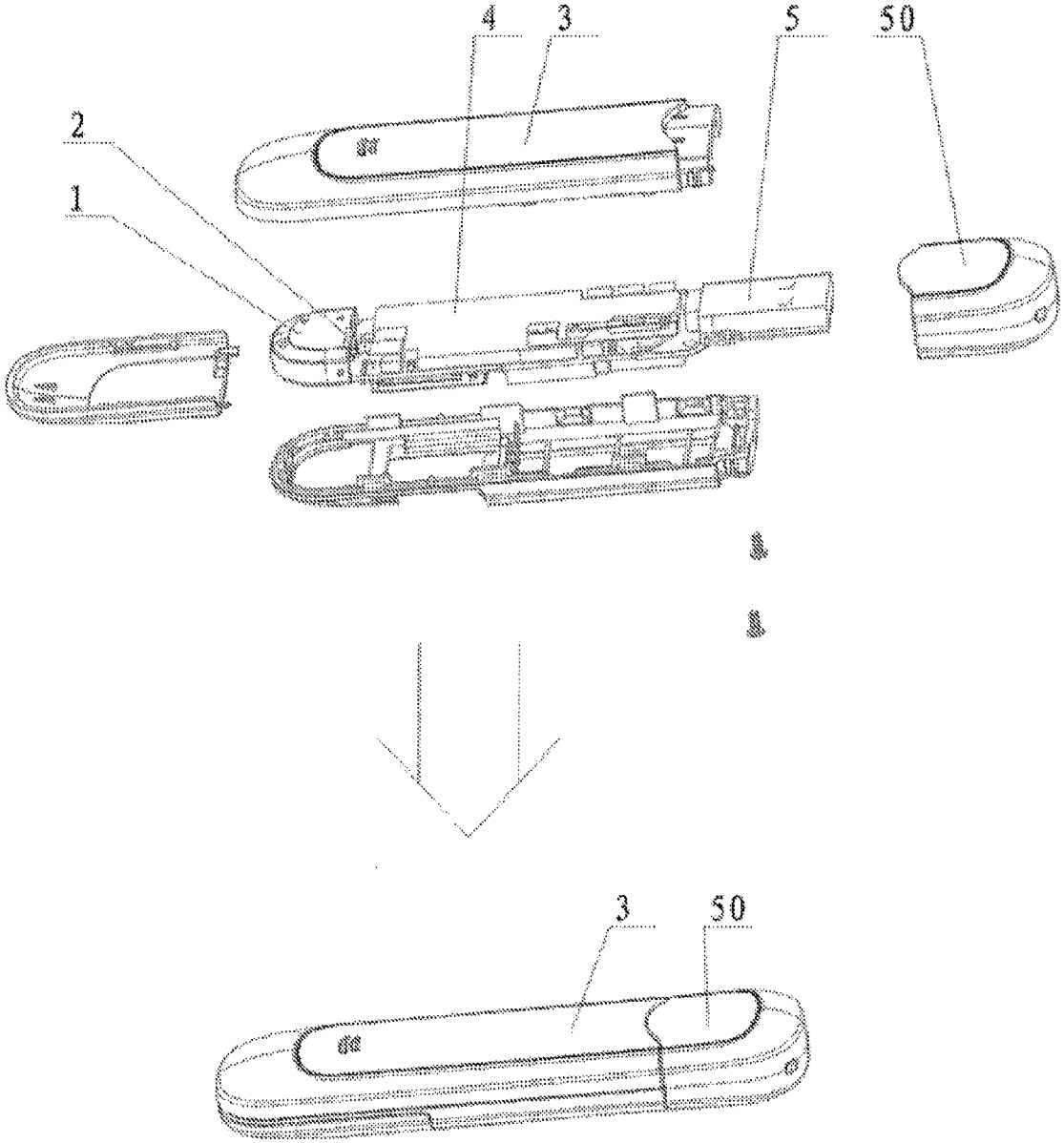
FIG. 1 is a schematic diagram showing the assembling process of an electronic device equipped with an existing antenna component.
Figure 2:
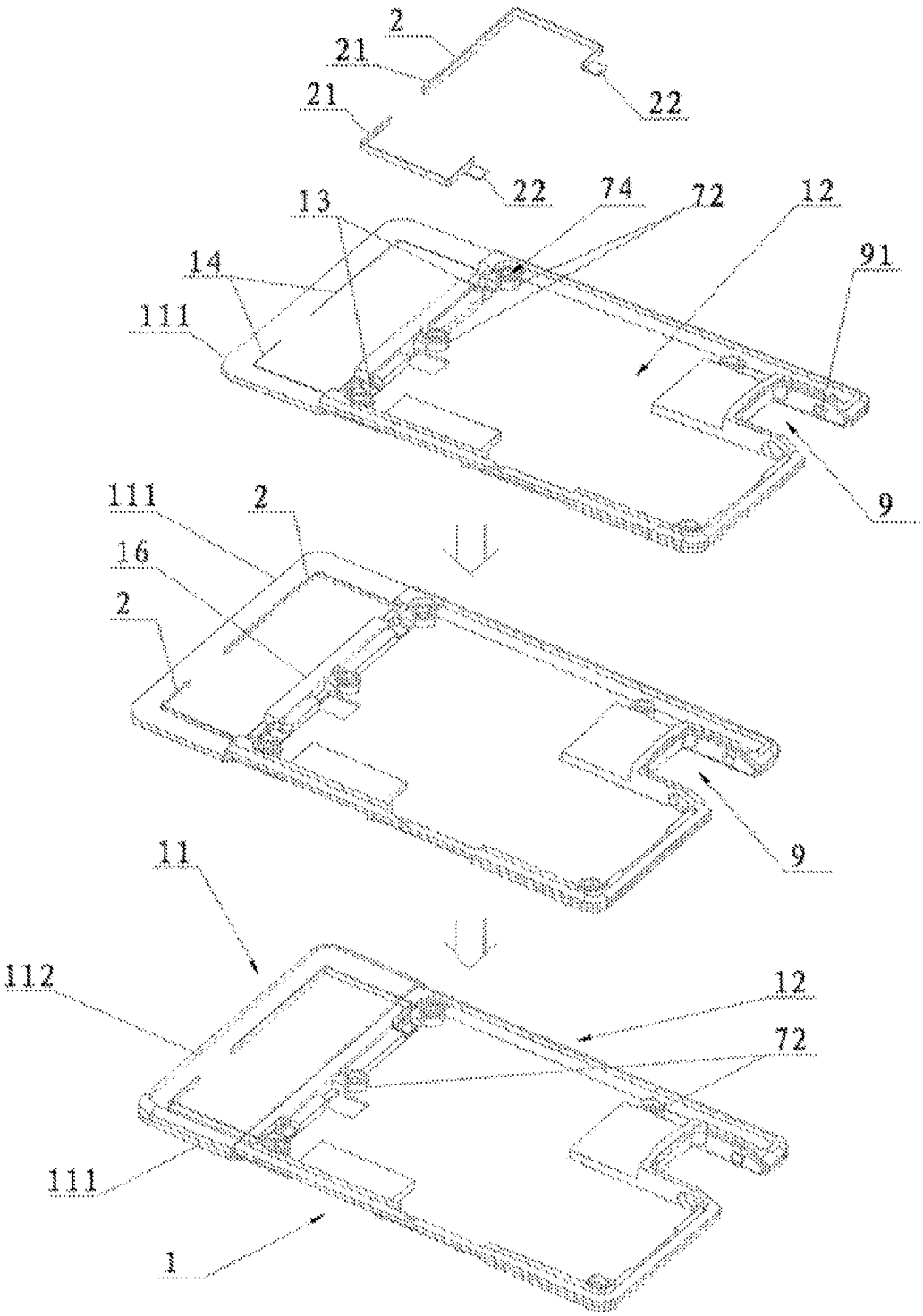
FIG. 2 is a schematic diagram showing the assembling process of an antenna component according to one embodiment of the invention.

As shown in FIG. 2, the antenna component according to the embodiment of the invention includes: a plate-shaped front cover 1 made of a transparent plastic material and at least one antenna 2 made of a conductor material, wherein the front cover 1 includes an antenna accommodation part 11 and a circuit accommodation part 12, one end of the antenna 2 is embedded in the antenna accommodation part 11 via an injection molding process, and the other end of the antenna 2 extends to the circuit accommodation part 12 and is exposed out of the circuit accommodation part 12.

Figure 7:
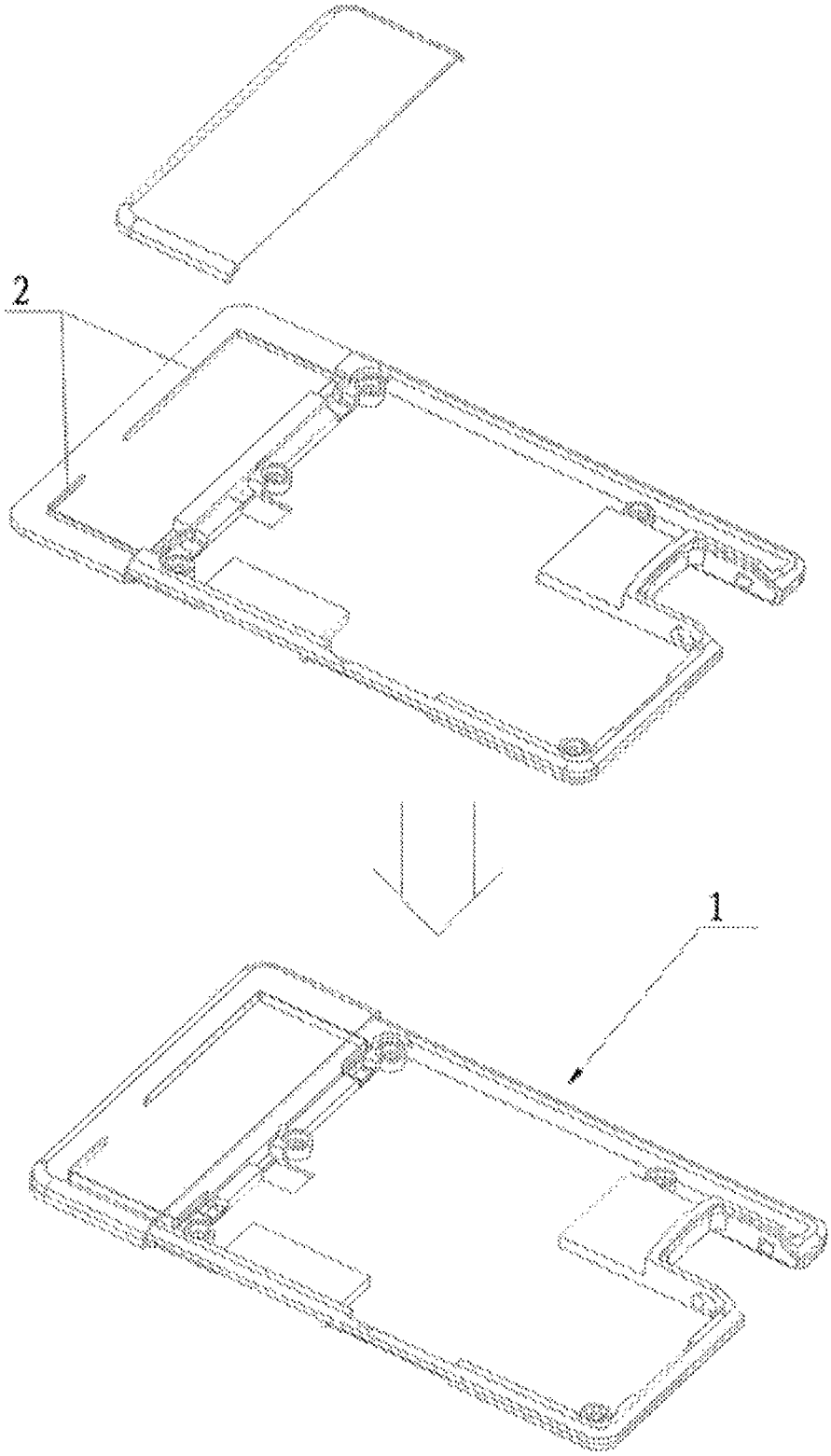
FIG. 7 is a schematic diagram showing the assembling process of an antenna component according to another embodiment of the invention.

In the antenna component according to the embodiments of the invention, the front cover 1 includes an antenna accommodation part 11 and a circuit accommodation part 12, and one end of the antenna 2 is embedded in the antenna accommodation part 11 via an injection molding process, and the other end of the antenna 2 extends to the circuit accommodation part 12 and is exposed out of the circuit accommodation part 12. The antenna 2 is embedded in the antenna accommodation part 11 via an injection molding process and thus no screw or bolt, or a connection structure like screw or bolt, is arranged between the antenna 2 and the front cover 1. In comparison with the existing antenna component, due to the omit of the space occupied by the screw or bolt or a connection mechanism like screw or bolt, the overall volume of the front cover 1 and the antenna 2 can be made smaller. At the same time, because the front cover 1 is plate-shaped and no screw or bolt or a connection mechanism like screw or bolt is configured, the antenna component can be made more thinner and lighter, thereby solving the technical problem that the volume of existing antenna components is large;

Additionally, by injection-molding the antenna 2 in the front cover 1 via an injection molding process, not only the manufacturing efficiency can be made high, but also the connection structure between the antenna 2 and the front cover 1 can be made firm. However, in this embodiment, there exist many other modes for embedding an end of the antenna 2 into the front cover 1. For example, as shown in FIG. 7, the front cover 1 may be divided into two parts. A part of the antenna 2 is placed between the two parts of the front cover 1 and then one end of the antenna 2 is embedded in the front cover 1 by binding the two parts of the front cover 1 together via glue. Or, one end of the antenna 2 may embedded in the front cover 1 by employing fastener fitting connection and so on. The other end extends out of the front cover 1.

Because transparent material includes completely transparent material and semi-transparent material, in this embodiment, the antenna accommodation part 11 and the circuit accommodation part 12 may be both of a completely transparent material or a semi-transparent material, and one of the antenna accommodation part 11 and the circuit accommodation part 12 may be of a completely transparent material or a semi-transparent material, and the other may be of a semi-transparent material or a completely transparent material.

By manufacturing the front cover 1 with a transparent material, not only the appearance of the antenna component may be made stylish and elegant, but also the antenna 2 in the front cover 1 and the devices sheltered by the front cover 1 may be seen from outside, so that it is favorable to accurately judge whether the positions of the antenna 2 and other devices sheltered by the front cover 1 are correct, thereby it is convenient for identifying and adjusting the positions of the antenna 2 or other devices sheltered by the front cover 1.

Figure 3:
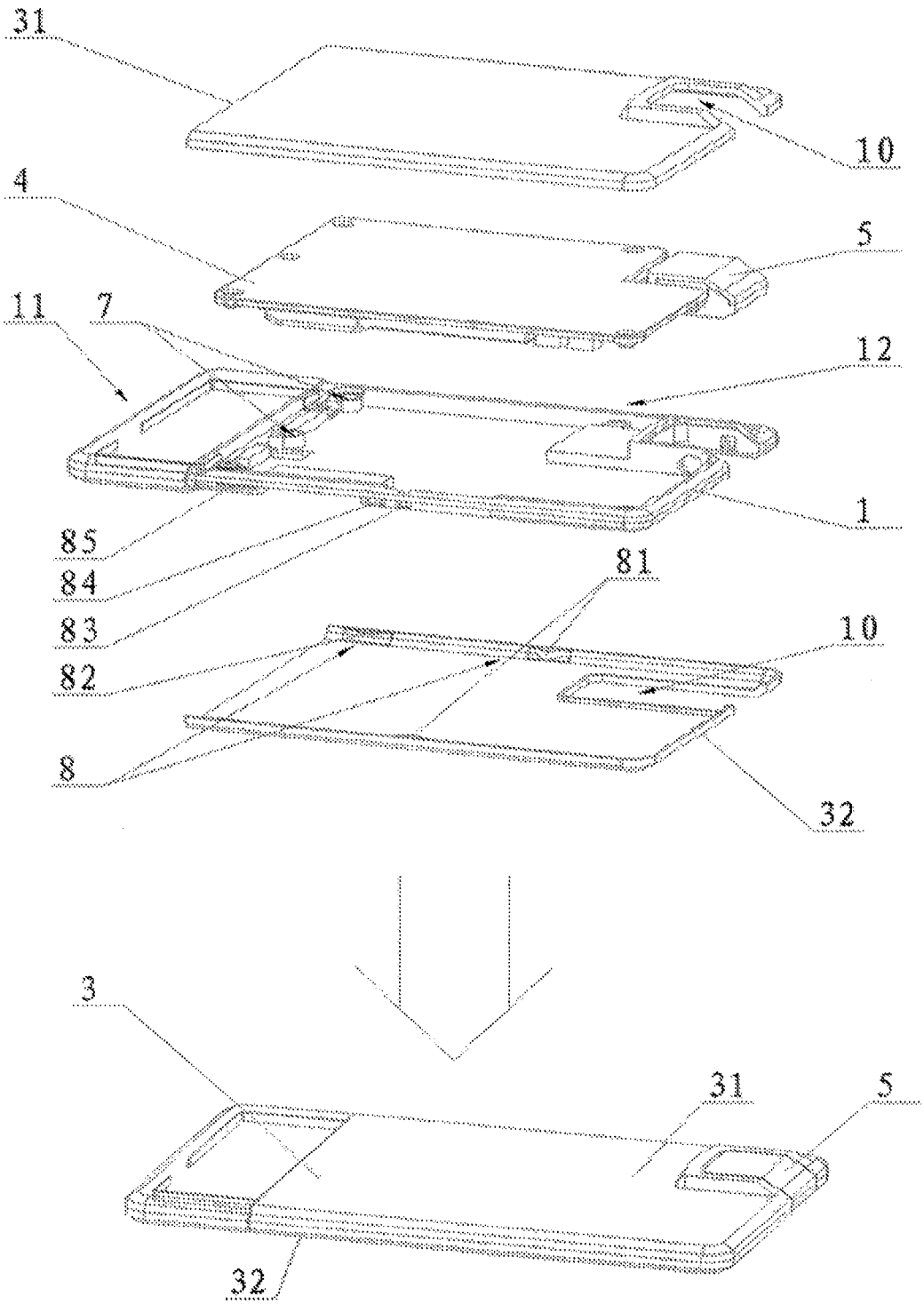
FIG. 3 is one schematic diagram showing the assembling process of an electronic communication device equipped with the antenna component according to the embodiment of the invention shown in FIG. 2.

As shown in FIG. 2 and FIG. 3, the electronic communication device according to the embodiment of the invention includes a housing 3, a circuit board 4 and an antenna component as shown in FIG. 3. The antenna component includes a plate-shaped front cover 1 made of a transparent plastic material and at least one antenna 2 made of a conductor material, wherein the front cover 1 includes an antenna accommodation part 11 and a circuit accommodation part 12, one end of the antenna 2 is embedded in the antenna accommodation part 11 via an injection molding process, and the other end of the antenna 2 extends to the circuit accommodation part 12 and is exposed out of the circuit accommodation part 12, and the other end of the antenna 2 is pressed against and thus electrically connected with an antenna contact 6 on the circuit board 4. The housing 3 covers the circuit board 4 and the circuit accommodation part 12.

In the antenna component according to the embodiments of the invention, the front cover 1 includes an antenna accommodation part 11 and a circuit accommodation part 12. One end of the antenna 2 is embedded in the antenna accommodation part 11 via an injection molding process, and the other end of the antenna 2 extends to the circuit accommodation part 12 and is exposed out of the circuit accommodation part 12. The antenna 2 is embedded in the antenna accommodation part 11 via an injection molding process and thus no screw or bolt, or a connection structure like screw or bolt, is arranged between the antenna 2 and the front cover 1. In comparison with the existing antenna component, due to the omit of the space occupied by the screw or bolt or a connection mechanism like screw or bolt, the overall volume of the front cover 1 and the antenna 2 can be made smaller. At the same time, because the front cover 1 is plate-shaped and no screw or bolt or a connection mechanism like screw or bolt is arranged, the antenna component can be made more thinner and lighter, thereby solving the technical problem that the volume of existing antenna components is large.

When an antenna component according to the embodiments of the invention is arranged on an electronic communication apparatus, the volume of the electronic communication device can also be made smaller and thinner and the electronic communication device will be easier for a user to carry and use.

At the same time, because in the embodiment of the invention, the front cover 1 is made of a transparent plastic material, when an indicator lamp or other light-emitting device in the housing of the electronic communication device emits light, the light may penetrate through the front cover 1, so that a flare effect will be generated on the whole front cover 1, and a greater aesthetic sense will be made on its appearance.

Additionally, by injection-molding the antenna 2 in the front cover 1 via an injection molding process, not only the manufacturing efficiency can be made high, but also the connection structure between the antenna 2 and the front cover 1 can be made firm. However, in this embodiment, there exist many other modes for embedding an end of the antenna 2 into the front cover 1. For example, as shown in FIG. 7, the front cover 1 may be divided into two parts. A part of the antenna 2 is placed between the two parts of the front cover 1 and then one end of the antenna 2 is embedded in the front cover 1 by binding the two parts of the front cover 1 together via glue. Or, one end of the antenna 2 is embedded in the front cover 1 by employing fastener fitting connection and so on. The other end extends out of the front cover 1.

Because transparent material includes completely transparent material and semi-transparent material, in this embodiment, the antenna accommodation part 11 and the circuit accommodation part 12 may be both of a completely transparent material or a semi-transparent material, and one of the antenna accommodation part 11 and the circuit accommodation part 12 may be of a completely transparent material or a semi-transparent material, and the other may be of a semi-transparent material or a completely transparent material.

By manufacturing the front cover 1 with a transparent material, not only the appearance of the antenna component may be made stylish and elegant, but also the antenna 2 in the front cover 1 and the devices sheltered by the front cover 1 may be seen from outside, so that it is favorable to accurately judge whether the positions of the antenna 2 and other devices sheltered by the front cover 1 are correct, thereby it is convenient for identifying and adjusting the positions of the antenna 2 or other devices sheltered by the front cover 1.

Figure 4:
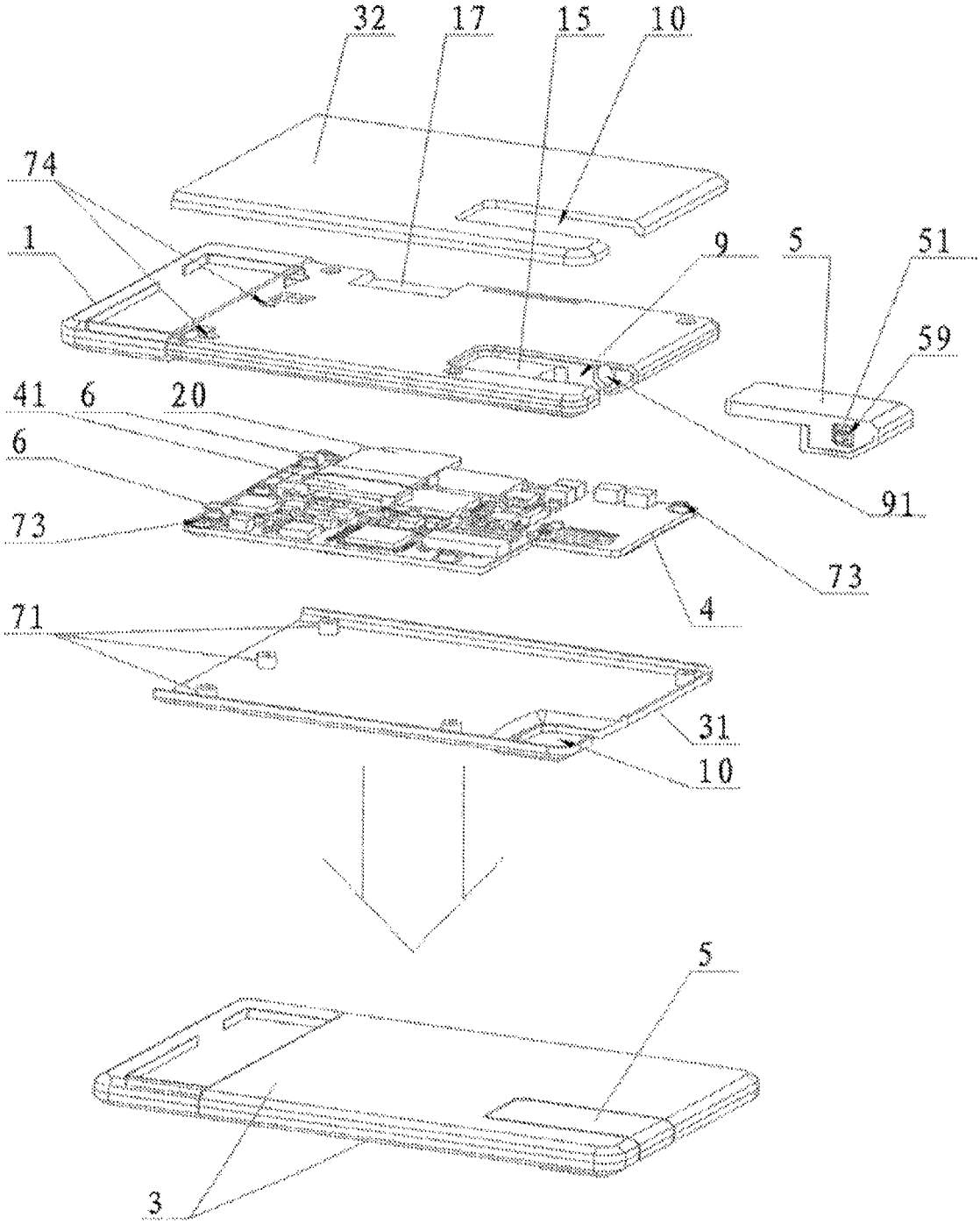
FIG. 4 is another schematic diagram showing the assembling process of the electronic communication device equipped with the antenna component according to the embodiment of the invention shown in FIG. 2.
Figure 5:
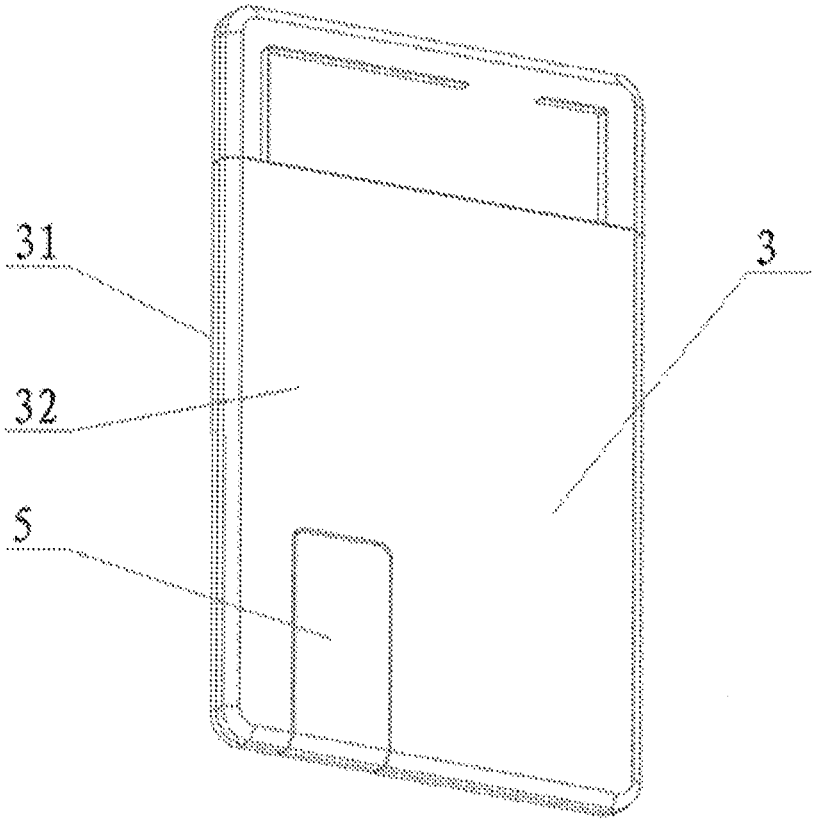
FIG. 5 is 3D structural representation of an electronic communication device equipped with the antenna component according to the embodiment of the invention shown in FIG. 2.

As shown in FIG. 3 and FIG. 4, the housing 3 includes a first housing cap 31 and a second housing cap 32, wherein For two sides of the front cover 1 that are opposite to each other, one side is opposite to the circuit board 4 and the first housing cap 31, and the other side is opposite to the second housing cap 32.

The front cover 1 is detachably connected with the circuit board 4 and the first housing cap 31 via a thread connection structure 7 as shown in FIG. 3.

The front cover 1 is detachably connected with the second housing cap 32 via a fastener structure 8 as shown in FIG. 3.

The thread connection structure 7 and the fastener structure 8 both have the advantages of simple structure and easy installation.

In this embodiment, the thread connection structure 7 as shown in FIG. 3 includes a first location column 71 fixedly arranged on the first housing cap 31, as shown in FIG. 4, a second location column 72 fixedly arranged on the front cover 1, as shown in FIG. 2, and a first location hole 73 arranged in the circuit board 4, as shown in FIG. 4. A counter bore is arranged on the first location column 71 and a second location hole 74 as shown in FIG. 2 is arranged on the second location column 72. As shown in FIG. 4, the thread part of the screw passes through the second location hole 74 and the first location hole 73 in turn, and then is embedded in the counter bore on the first location column, so that the front cover 1 is fixed together with the circuit board 4 and the first housing cap 31. In such a structure, the thread part of the screw is finally embedded in the counter bore on the first location column that is fixedly connected with the first housing cap 31. The end head of the screw far away from the thread part thereof may be sheltered by the second housing cap 32, thus the appearance of the whole electronic communication device will be elegant.

As shown in FIG. 4, in this embodiment, the circuit board 4 is equipped with a screw nut via a Surface Mounted Technology (SMT) process. The first location hole 73 will be the screw hole of the screw nut. The fitting between the screw hole and the thread part of the screw will be more secure, so it will be helpful to improve the reliability of the thread connection structure 7 as shown in FIG. 3.

As shown in FIG. 3, in this embodiment, the fastener structure 8 includes an anti-detach bulge 81 and an anti-detach buckle 82 fixedly arranged on the edges of the second housing cap 32 that are opposite to each other and extending to the center region of the second housing cap 32, a first stopper 83 and a second stopper 84 fixedly arranged on the edges of the front cover 1 that are opposite to each other, and a stopper groove 85 arranged in the edges of the front cover 1 that are opposite to each other. The length direction (which is the maximum extending direction) of the stopper groove 85 is parallel to the length direction of the front cover 1, wherein The first stopper 83 and the second stopper 84 are arranged in turn along the length direction of the front cover 1. When the second housing cap 32 is inserted on the front cover 1, the anti-detach bulge 81 will be embedded between the first stopper 83 and the second stopper 84, and the anti-detach buckle 82 will be embedded in the stopper groove 85.

When the anti-detach bulge 81 is embedded between the first stopper 83 and the second stopper 84, the fitting structure formed of the first stopper 83, the second stopper 84 and the anti-detach bulge 81 limits the movement of the second housing cap 32 along the direction parallel to the maximum extending plane of the front cover 1. The fitting structure between the anti-detach buckle 82 and the stopper groove 85 limits the movement of the second housing cap 32 along the direction perpendicular to the maximum extending plane of the front cover 1.

As shown in FIG. 3, in this embodiment, the anti-detach bulge 81 is in the form of a convex closed angle and the anti-detach buckle 82 is in the form of a flake. The anti-detach bulge 81 and the anti-detach buckle 82 are both formed by bending a metal sheet and fixed on the second housing cap 32 of a metal material via soldering. The second housing cap 32 is preferably of an aluminum alloy material. The connection strength between the anti-detach bulge 81 and the anti-detach buckle 82 fixed on the second housing cap 32 via soldering and the second housing cap 32 is more reliable. However, in this embodiment, the anti-detach bulge 81, the anti-detach buckle 82 and the second housing cap 32 may also form a one-piece structure, or may be fixedly connected in other fixing modes such as riveting and binding, etc.

Figure 8:
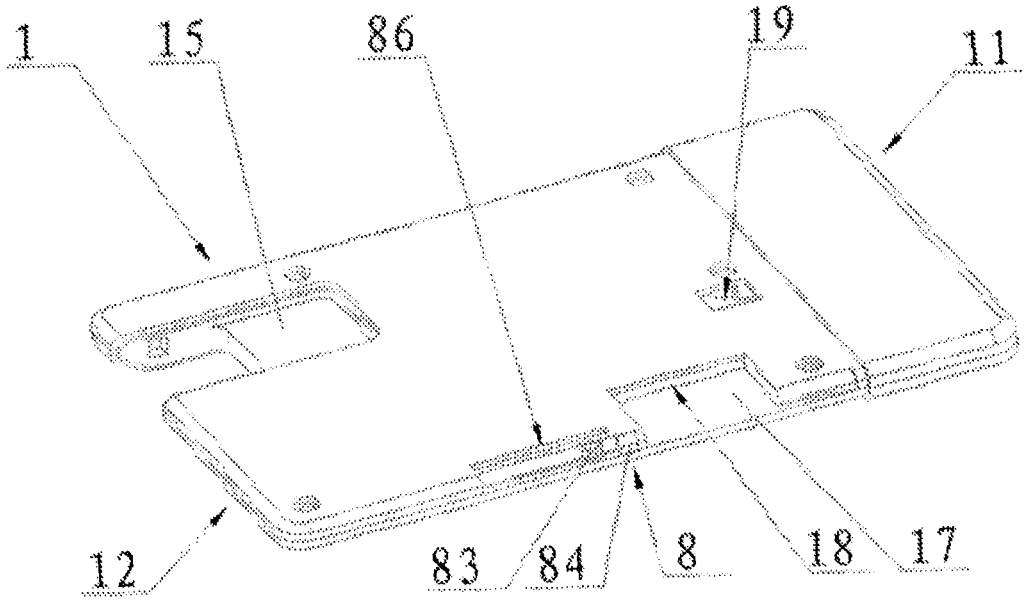
FIG. 8 is a 3D structural representation of the antenna component according to one embodiment of the invention.

As shown in FIG. 8, as a further modification of the fastener structure 8 according to the embodiment shown in FIG. 3, in this embodiment, a resilience groove 86 extending along the length direction of the front cover is further arranged on the front cover 1 around the first stopper 83. The resilience groove 86 reduces the material of the front cover 1 around the first stopper 83, so the stretching space of the first stopper 83 in the width direction of the electronic communication device may be increased. As a result, the resilience of the first stopper 83 can be improved, thereby it is helpful to improve the reliability of the fitting of the fastener structure 8.

As shown in FIG. 2, in this embodiment, the antenna accommodation part 11 includes a base part 111 and a cap part 112, wherein A fixing slot 14 is arranged on the base part 111, and a part of the antenna 2 is embedded in the fixing slot 14.

The cap part 112 is injection-molded on the base part 111 and covers the antenna 2 embedded in the fixing slot 14.

Because a fixing slot 14 is arranged on the base part 11, the antenna 2 may be installed to a position required rapidly and accurately by inserting the antenna 2 in the fixing slot 14, and the antenna 2 may be firmly fixed on the base part 11 via the cap part 112 injection-molded. However, in this embodiment, the fixing slot 14 may also be arranged on the cap part 112.

As shown in FIG. 2, in this embodiment, a spacer bar 16 is further fixedly arranged on the sides of the antenna accommodation part 11 and the circuit accommodation part 12 adjacent to the first housing cap 31. The spacer bar 16 may separate the antenna accommodation part 11 from the circuit accommodation part 12, so that mutual influence between devices installed in the antenna accommodation part 11 and devices installed in the circuit accommodation part 12 may be avoided.

As a further modification of this embodiment, the base part 111 and the circuit accommodation part 12 of the embodiment shown in FIG. 2 form a one-piece structure. The base part 111 and the circuit accommodation part 12 of the one-piece structure may be manufactured via a one-step molding process, thus the manufacturing efficiency will be high, and the connection strength between each parts of the one-piece structure will be high. In this embodiment, the base part 111 preferably forms a one-piece structure with the circuit accommodation part 12, the second location column 72, the first stopper 83, the second stopper 84 and the spacer bar 16. At this point, the front cover 1, which contains the base part 111, the circuit accommodation part 12, the second location column 72, the first stopper 83, the second stopper 84 and the spacer bar 16, may be manufactured simultaneously via a one-step molding process.

As shown in FIG. 2, the antenna 2 includes a receiving part 21 and a connecting part 22 connected with each other, wherein, as shown in FIG. 3, the circuit board 4 is placed on the circuit accommodation part 12, and the circuit board 4 is located between the circuit accommodation part 12 and the first housing cap 31. As shown in FIG. 2, the receiving part 21 is embedded in the fixing slot 14, and the connecting part 21 extends to the circuit accommodation part 12 and is exposed out of the circuit accommodation part 12. The connecting part 21 is pressed against and thus electrically connected with the antenna contact 6 on the circuit board 4 as shown in FIG. 4.

On one hand, in such a structure, the space in the length direction of the electronic communication device and the front cover 1 may be fully utilized, so that the size in the thickness direction of the electronic communication device may be made thin. On the other hand, because the space in the length direction of the electronic communication device and the front cover 1 is abundant, and at the same time, the receiving part 21 of the antenna 2 is adapted to receive or emit a wireless signal. In such a structure, the distance between the receiving part 21 and the circuit board 4 is configured large, so that the mutual influence between various devices on the circuit board 4 and the receiving part 21 of the antenna 2 may be avoided.

As shown in FIG. 2, the receiving part 21 and the connecting part 22 are both in the form of a bar-shaped sheet. The width direction of the receiving part 21 is perpendicular to the extending direction of the maximum plane of the antenna accommodation part 11, and the width direction of the connecting part 22 is parallel to the extending direction of the maximum plane of the circuit accommodation part 12.

The receiving part 21 and the connecting part 22 both in the form of a bar-shaped sheet may be made by bending a metal sheet. When the width direction of the receiving part 21 is perpendicular to the extending direction of the maximum plane of the antenna accommodation part 11, the receiving part 21 occupies a large area in the thickness direction of the electronic communication device, which is favorable to improve the wireless signal receiving performance of the antenna 2. When the width direction of the connecting part 22 is parallel to the extending direction of the maximum plane of the circuit accommodation part 12, the connecting part 22 is opposite to the antenna contact 6 on the circuit board 4 as shown in FIG. 4. When the connecting part 22 and the antenna contact 6 are pressed to contact, not only it is convenient for installation and contact area is relatively large, but also it is helpful to ensure the reliability of the electrical connection between the antenna contact 6 and the connecting part 22.

As shown in FIG. 2, as a further modification of this embodiment, a location slot 13 may be further arranged on the circuit accommodation part 12 of this embodiment, and the connecting part 22 is embedded in the location slot 13.

The location slot 13 may restrict the connecting part 22 in the direction parallel to the surface of the circuit accommodation part 12. Therefore, displacement of the connecting part 22 in the direction parallel to the surface of the circuit accommodation part 12 due to reasons such as jitter or vibration may be avoided, so that the reliability of the electrical connection between the connecting part 22 and the antenna contact 6 may be further ensured.

As shown in FIG. 3, an indicator lamp is further arranged between the first housing cap 31 and the second housing cap 32. The indicator lamp is electrically connected with the circuit board 4. The indicator lamp may indicate various states of the electronic communication device by blinking, for example, whether the electronic communication device is connected to a power source, whether the electronic communication device is in working state and whether the electronic communication device is transmitting data, etc. In this embodiment, because the front cover 1 is made of transparent material, the light emitted during the blinking of the indicator lamp may penetrate through the front cover 1, and a user may judge various states of the electronic communication device by inspecting the light penetrating through the front cover 1.

At the same time, because the front cover 1 may be configured to various forms as required by users, the appearance design of the product may be more abundant and more elegant.

In addition, here, the part on the front cover 1 that is not covered by the first housing cap 31 and the second housing cap 32 may function as a lamp shade of the prior art, that is, the part may function to protect the indicator lamp. In this embodiment, in order to make the appearance design of the product more abundant and elegant, various shapes or labels such as the model number, manufacturer and device memory capacity may be sculptured on the part of the front cover 1 that is not covered by the first housing cap 31 and the second housing cap 32.

As shown in FIG. 4, in this embodiment, the electronic communication device further includes a plug 5 electrically connected with the circuit board 4, wherein, as shown in FIG. 2, a first notch 9 is further arranged on the edge of the circuit accommodation part 12, a second notch 10 that is opposite to the first notch 9 is further arranged on the edges of the first housing cap 31 and the second housing cap 32, an movable connection structure 59 is arranged between the side wall of the first notch 9 and the plug 5. The plug 5 may rotate relative to the side wall of the first notch 9 via the movable connection structure 59 to extend out of the second notch 10.

Because the plug 5 may rotate via the movable connection structure 59 as shown in FIG. 4 relative to the side wall of the first notch 9 and the plug 5 may extend out of the edge of the first housing cap 31 and the second housing cap 32 when the plug 5 extends out of the second notch 10, the plug 5 may be rotated to extend out of the first housing cap 31 and the second housing cap 32 when the plug 5 is being used. After the plug 5 is used, the plug 5 may be rotated to drawn back into the first housing cap 31 and the second housing cap 32, which not only is convenient for use, but also needs no protective cap on the plug 5.

As shown in FIG. 4, in this embodiment, the active connection structure 59 includes a rotation hole 91 arranged in the side wall of the first notch 9, a rotation axis 51 fixedly arranged on the plug 5 and an embedding slot 15 arranged in a side of the circuit accommodation part 12 adjacent to the second housing cap 32. The plug 5 is pin-jointed in the rotation hole 91 via the rotation axis 51. The plug 5 may rotate relative to the rotation hole 91 via the rotation axis 51, and may rotate to be embedded in the embedding slot 15.

When being used, the plug 5 may be rotated out of the embedding slot 15, so that the plug 5 may be at a position extending out of the first housing cap 31 and the second housing cap 32. After being used, the plug 5 may be again rotated to be embedded in the embedding slot 15.

Figure 6:
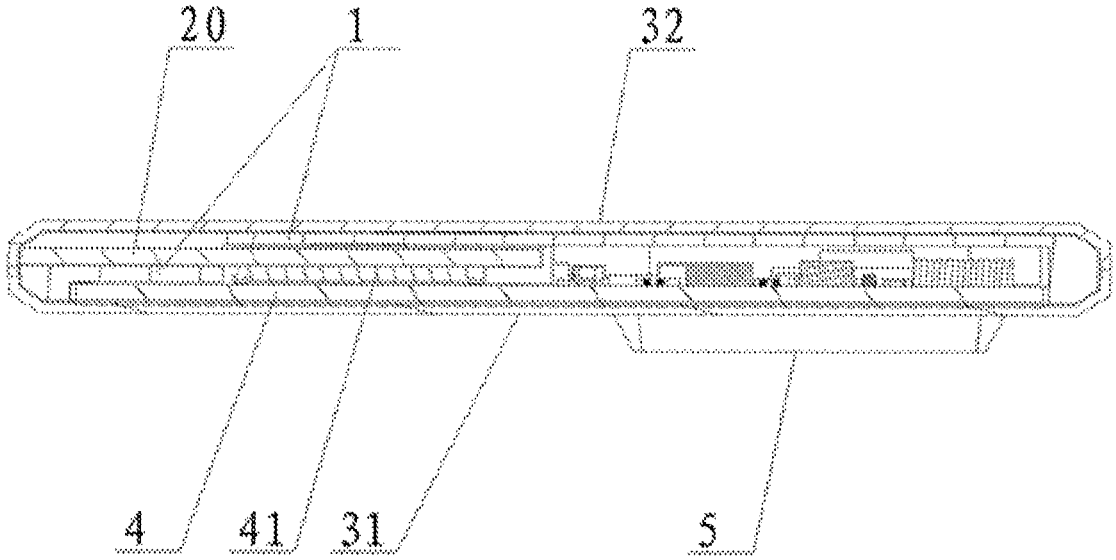
FIG. 6 is an enlarged schematic sectional view of the electronic communication device according to the embodiment of the invention as shown in FIG. 5 when a data card is inserted therein.

As shown in FIG. 8, in this embodiment, a card slot 17 is further arranged on a side of the circuit accommodation part 12 adjacent to the second housing cap 32. A slot via hole 18 is arranged on the side wall of the card slot 17. The slot via hole 18 is opposite to a data card socket 41 as shown in FIG. 4 and FIG. 6. The data card socket 41 is electrically connected with the circuit board 4.

The data card 20 may be embedded in the data card socket 41 as shown in FIG. 6 via the slot via hole 18 as shown in FIG. 8. In this embodiment, the data card socket 41 is a SIM card socket or a UIM card socket. The data card socket 41 is used for reading the data information in a SIM card or a UIM card and inputting the data information to the circuit board 4.

In this embodiment, the second housing cap 32 is preferably of an aluminum alloy material. A ground via hole 19 as shown in FIG. 8 is further arranged on the circuit accommodation part 12. The circuit board 4 is electrically connected with the second housing cap 32 via the ground via hole 19 and grounded via the second housing cap 32. However, in this embodiment, the first housing cap 31 may also be made of a conductor material, and the circuit board 4 may also be grounded via the first housing cap 31.

The antenna component includes two antennas 2. One of the two antennas 2 is a main antenna, and the other is a diversity antenna. The main antenna and the diversity antenna are respectively pressed against and thus electrically connected with the two antenna contacts 6 on the circuit board 4 as shown in FIG. 4. The main antenna is used for receiving or sending a wireless signal and the diversity antenna is only used for receiving a wireless signal. The diversity antenna coordinates with the main antenna to receive a wireless signal and functions to assist the receiving of a wireless signal, thus it is helpful to improve the wireless signal receiving effect.

In this embodiment, the electronic communication device is preferably a data card, and the plug 5 may be a USB plug. It is required that the data card is slight, thin and small, and the above technical solutions according to the embodiments of the invention may be adapted to reduce the volume thereof. However, the electronic communication device may also other electronic devices in addition to data card.

The objects, technical solutions and beneficial effects of the invention have been illustrated in further detail by the above specific embodiments. However, it should be understood that the above embodiments are only some specific embodiments of the invention, rather than limiting the protection scope of the invention. All the modifications, equivalent substitutions and improvements without departing from the spirit and principle of the invention should be construed as pertaining to the protection scope of the invention.

What is claimed is:

1. An antenna component, comprising:

a plate-shaped front cover made of a transparent plastic material and at least one antenna made of a conductor material; wherein:

the plate-shaped front cover comprises an antenna accommodation part and a circuit accommodation part, one end of the antenna is embedded in the antenna accommodation part via an injection molding process, and the other end of the antenna extends to the circuit accommodation part and is exposed out of the circuit accommodation part, wherein the antenna accommodation part and the circuit accommodation part are positioned on different ends of the plate-shaped front.

2. An electronic communication device, comprising:

a housing, a circuit board and an antenna component, the antenna component comprises a plate-shaped front cover made of a transparent plastic material and at least one antenna made of a conductor material, wherein:

the plate-shaped front cover comprises an antenna accommodation part and a circuit accommodation part;

one end of the antenna is embedded in the antenna accommodation part via an injection molding process, and the other end of the antenna extends to the circuit accommodation part and is exposed out of the circuit accommodation part, and the other end of the antenna is pressed against and thus electrically connected with an antenna contact on the circuit board, wherein the antenna accommodation part and the circuit accommodation part are positioned on different ends of the plate-shaped front; and the housing covers the circuit board and the circuit accommodation part.

3. The electronic communication device according to claim 2, wherein the antenna component comprises two antennas, one antenna is a main antenna, and the other antenna is a diversity antenna, and the main antenna and the diversity antenna are respectively pressed against and thus electrically connected with the two antenna contacts on the circuit board.

4. The electronic communication device according to claim 2, wherein:

the housing comprises a first housing cap and a second housing cap;

the plate-shaped front cover comprises two sides opposite to each other, one side is opposite to the circuit board and the first housing cap, and the other side is opposite to the second housing cap;

the plate-shaped front cover is detachably connected with the circuit board and the first housing cap via a thread connection structure; and the plate-shaped front cover is detachably connected with the second housing cap via a fastener structure.

5. The electronic communication device according to claim 4, wherein:

the antenna accommodation part comprises a base part and a cap part;

a fixing slot is arranged on the base part, and a part of the antenna is embedded in the fixing slot;

the cap part is injection-moulded on the base part and covers the antenna embedded in the fixing slot.

6. The electronic communication device according to claim 5, wherein the base part and the circuit accommodation part form a one-piece structure.

7. An electronic communication device, comprising:

a housing, a circuit board and an antenna component, the antenna component comprises a plate-shaped front cover made of a transparent plastic material and at least one antenna made of a conductor material, wherein:

the plate-shaped front cover comprises an antenna accommodation part and a circuit accommodation part;

one end of the antenna is embedded in the antenna accommodation part via an injection molding process, and the other end of the antenna extends to the circuit accommodation part and is exposed out of the circuit accommodation part, and the other end of the antenna is pressed against and thus electrically connected with an antenna contact on the circuit board;

the housing covers the circuit board and the circuit accommodation part;

wherein:

the housing comprises a first housing cap and a second housing cap;

the plate-shaped front cover comprises two sides opposite to each other, one side is opposite to the circuit board and the first housing cap and the other side is opposite to the second housing cap;

the plate-shaped front cover is detachably connected with the circuit board and the first housing cap via a thread connection structure;

the plate-shaped front cover is detachably connected with the second housing cap via a fastener structure;

wherein:

the antenna accommodation part comprises a base part and a cap part;

a fixing slot is arranged on the base part, and a part of the antenna is embedded in the fixing slot;

the cap part is injection-moulded on the base part and covers the antenna embedded in the fixing slot; and wherein:

the antenna comprises a receiving part and a connecting part that are connected with each other;

the circuit board is placed on the circuit accommodation part, and the circuit board is located between the circuit accommodation part and the first housing cap; and the receiving part is embedded in the fixing slot, the connecting part extends to the circuit accommodation part and is exposed out of the circuit accommodation part, and the connecting part is pressed against and thus electrically connected with the antenna contact on the circuit board.

8. The electronic communication device according to claim 7, wherein the receiving part and the connecting part are both in the form of a bar-shaped sheet, the width direction of the receiving part is perpendicular to the extending direction of the maximum plane of the antenna accommodation part, and the width direction of the connecting part is parallel to the extending direction of the maximum plane of the circuit accommodation part.

9. The electronic communication device according to claim 7, wherein an indicator lamp is further arranged between the first housing cap and the second housing cap, and the indicator lamp is electrically connected with the circuit board.

10. The electronic communication device according to claim 7, wherein:

the electronic communication device further comprises a plug electrically connected with the circuit board;

the edge of the circuit accommodation part is further provided with a first notch, and the edges of the first housing cap and the second housing cap are further provided with a second notch that is opposite to the first notch; and a movable connection structure is arranged between the side wall of the first notch and the plug, and the plug may be rotated relative to the side wall of the first notch via the movable connection structure to extend out of the second notch.

* * * * *